United States Patent [19]

Kawakatsui Ichiro

[11] Patent Number: 4,830,826

[45] Date of Patent: May 16, 1989

[54] PROCESS OF MANUFACTURING HIGH-STRENGTH HIGH-ELASTICITY ALUMINUM ALLOYS

[75] Inventor: Kawakatsui Ichiro, 3-30-13, Saginomiya, Nakano-ku, Tokyo, Japan

[73] Assignees: Matsuo Kogyo Kabushiki Kaisha, Nagano; Ichiro Kawakatsu, Tokyo, both of Japan

[21] Appl. No.: 100,964

[22] Filed: Sep. 24, 1987

[30] Foreign Application Priority Data

Sep. 26, 1986 [JP] Japan ..... 61-225898

[51] Int. Cl.[4] ..... C22C 21/00

[52] U.S. Cl. ..... 420/532; 148/2; 148/3; 148/12.7 A; 148/159; 148/417

[58] Field of Search ..... 148/2, 3, 12.7 A, 159, 148/417; 420/532

[56] References Cited

U.S. PATENT DOCUMENTS 3,531,337 9/1970 Kawakatsu ..... 148/3
3,539,308 11/1970 Nowak ..... 420/541
3,794,531 2/1974 Markworth ..... 148/159

FOREIGN PATENT DOCUMENTS 48-29446 9/1973 Japan ..... 148/159
0656476 8/1951 United Kingdom ..... 148/159

OTHER PUBLICATIONS

I. J. Polmear: "The Aging Characteristics of Complex Al-Zn-Mg Alloys", J. Inst. Metals, 88, pp. 51-59 (1960).

*Primary Examiner*—R. Dean
*Attorney, Agent, or Firm*—Birch, Stewart, Kolasch & Birch

[57] ABSTRACT

In order to manufacture high-strength high-elasticity Al alloys suitable for constructive machine parts and for terminal equipment parts for electronic devices, alloys consisting by wt % of 3.2~8.0% Zn, 1.2~4.5% Mg, 0.2~1.5% Cu, 0.1~1.2% Mn, 0.1~0.5% Cr, 0.005-0.2% B, 0.2~1.0% Be, 0.1~1.2% Ni and/or Co, 0.05~1.2% Zr and/or Hf, 0.05~3.0% Ag, and balance Al and unavoidable impurities, are subjected to nitriding treatment in molten state before being cast into ingots, and the ingot which is formed by plastic working is subjected to solution treatment followed by age-hardening treatment to increase strength and elasticity.

11 Claims, No Drawings

PROCESS OF MANUFACTURING HIGH-STRENGTH HIGH-ELASTICITY ALUMINUM ALLOYS

FIELD OF THE INVENTION AND RELATED ART STATEMENT

The present invention relates to a process of manufacturing high-strength high-elasticity Al alloys, in more detail to a process of manufacturing high-strength high-elasticity Al alloys suitable for screws such as bolts and nuts, mechanical structural parts such as washers and springs, and terminal instrumental parts for electronic devices; where especially, the alloys should have improved elasticity.

Conventional high-strength Al alloys were invented by the present inventor and disclosed in Japanese Patent Publication No. 48-31807. These alloys are prepared by applying a nitriding treatment to molten metal for which small amounts of Ni and/or Co; Zr and/or Hf; B, Be, etc. have been added to Al-Zn-Mg-Cu systems. These alloys, after being subjected to a solution treatment and an aging treatment (T6 treatment), acquire tensile strengths higher than 60 kg/mm$^2$ and, when successively subjected to cold working (T9 treatment), acquire tensile strengths higher than 70 kg/mm$^2$ and Vickers hardnesses higher than 210 Hv, comparable with those of mild steel and Cu-system nonferrous alloys. These Al alloys possess high abrasion resistance and low Cu content so as to be suitable as raw materials with high corrosion resistance and surface treat-ability for various mechanical parts.

Recently, demand has been increasing for Al alloys suitable for light-weight, high-strength, high-elasticity springs which may be used as parts of various devices, especially terminal equipments for electronic devices and precision instruments. In general, Al alloys, including the above-mentioned ones, do not possess satisfactory spring properties, and at present few are in practical use as spring materials.

SUMMARY OF THE INVENTION

The object of the present invention is to provide Al alloys which are superior in spring properties to phosphor bronze representative of the nonferrous alloy spring materials.

The process of manufacturing high-strength high-elasticity Al alloys of the present invention consists of nitriding Al alloys containing by wt% 3.2~8.0% Zn, 1.2~4.5% Mg, 0.2~1.5% Cu, 0.1~1.2% Mn, 0.1~0.5% Cr, 0.005~0.2% B, 0.02~1.0% Be, 0.1~1.2% Ni and/or Co, 0.05~1.2% Zr and/or Hf, 0.05~3.0% Ag, and balance Al and unavoidable impurities, casting the Al alloys into ingots, and subjecting the ingot which is formed by plastic working to a solution treatment and finally to an age-hardening treatment for increasing strength and elasticity.

Of the above constituent elements, Zn and Mg will effectively form $MgZn_2$ in the content ranges 3.2~8.0% for Zn and 1.2~4.5% for Mg, with acceleration of the age-hardenng and contribution to strength increase. Below the lower limits of the above ranges hardening and strength increase are insufficient, and above the upper limits machinability and corrosion resistance and unfavorable.

Cu contributes to age-hardening and strength increase in the content range 0.2~1.5%. Above the upper limit, corrosion resistance is greatly deteriorated and the surface treatability for anodic oxidation treatment, etc. is lowered.

With respect to the addition of Ni or Co in the content range 0.1~1.2%, much of them does not dissolve in Al but forms intermetallic compounds with Al and concentrates near grain boundaries, thereby increasing the density of dislocations and accelerating work hardening. Above 1.2%, machinability is deteriorated, whereas below 0.1% the addition has little effect.

Zr (replaceable by Hf in some cases) and B, when added in the content ranges 0.05~1.2% Zr, and 0.005~0.2% B, respectively, form nitrides in dispersed particles by the nitriding treatment. Each nitride in dispersed particles is capable of preventing the migration of dislocations through sliding deformation and thus, is effective for dispersion hardening. Zr and its group elements have no effect below the lower limit, and above the upper limit they will impair machinability or be liable to cause embrittlement.

Cr and Mn are effective for the promotion of corrosion resistance since they prevent the embrittlement of grain boundaries through making crystal grains fine. Cr is effective for the prevention of intergranular corrosion and stress corrosion in the content range 0.1~0.5%, but above 0.5% produces coarse precipitates with deteriorated machinability. Mn improves malleability in the range 0.1~1.2%, but has no effect above 1.2%.

Be promotes age-hardening and is considered to simultaneously display dispersion hardening effect through nitride formation similarly to Zr and B. In the range 0.02~1.0% it contributes to increase in strength and hardness, without deteriorating toughness.

The most characteristic point of the present invention is the addition of Ag. The addition of Ag in the range 0.05~3.0% promotes age-hardening and increases elasticity. The reason for setting the limits on the Ag addition is because below 0.05% little effect is obtained and above 3.0% hardness is increased, but with lowered machinability. As to the effect of Ag, Ag forms the zeta phase (mainly of $AgAl_2$) which has a solid-solution limit as high as Ag 55.6% at a high temperature (566° C.) with Al but one as low as less than Ag 0.7% at 150° C., and therefore, aging treatment after solution treatment is considered to allow the zeta phase to precipitate with promoted hardening accompanied with augmented spring properties.

Si and Fe, the unavoidable impurities, are desirable if present in as low a content as possible. However, they are permitted to be present at maximum contents of 0.3% for Si and 0.4% for Fe lest the mechanical properties relating the present invention should be deteriorated.

In steps of the manufacture of the Al alloys, it is favorable to add Zn and Mg after nitrogen gas has been blown into an alloy melt, from the standpoint of the prevention of Zn and Mg oxidation.

According to the present invention, the A1 alloys for which Ag is added to basic compositions have increased strength and hardness, especially excellent spring limit value higher by more than 10% than those without Ag added, superior to phosphor bronze representative of nonferrous alloy spring materials. Thus, the present invention is capable of providing materials highly suitable for structural parts of various electronic instruments, especially springs.

DETAILED DESCRIPTION OF PREFERRED EMBODIMENTS

Preferred embodiments of this invention will be described.

Table 1 shows an example of a basic chemical composition of Al alloy.

TABLE 1

| Element | Zn | Mg | Cu | Zr | Cr | Ni | Be | B | Al |
|---|---|---|---|---|---|---|---|---|---|
| wt % | 5.9 | 2.7 | 0.8 | 0.4 | 0.15 | 0.1 | 0.02 | 0.01 | balance |

In this embodiment, five kinds of Al alloys were prepared by adding Ag in 0, 0.1, 0.3, 0.5, or 1.0 wt% to the basic chemical composition of Table 1.

In steps of the preparation, first all the components except Zn and Mg were added to an Al melt, the melt was kept around 750°~800° C., nitrogen gas purified through a fireproof blow pipe was blown into the melt for nitriding treatment, Zn and Mg were finally added for their prevention from oxidation, and the melt was cooled down to 50°~100° C. above the melting point of the alloy before being cast into an ingot.

These five kinds of Al alloys thus prepared were compared with one another in mechanical properties by subjecting each ingot to a hot working followed by a rolling into a 0.5 mm plate and subjecting each plate to a solution treatment at 440°~520° C. followed by an age-hardening (T6 treatment) at 85°~130° C.

These 0.5 mm Al alloy plates were compared with one another in mechanical properties by subjecting each alloy plate to a mechanical strength test and a spring property test. The spring property test adopted the repeated deflection test specified in Japanese Industrial Standard (JIS) H3130. The results obtained are given in Tables 2 and 3.

TABLE 2

| | Mechanical strength | | |
|---|---|---|---|
| Ag wt % | Tensile strength kg/mm$^2$ | Elongation % | Vickers hardness MHv |
| 0 | 61.2 | 12.5 | 181 |
| 0.1 | 63.8 | 11.8 | 187 |
| 0.3 | 64.5 | 10.4 | 191 |
| 0.5 | 65.6 | 9.7 | 193 |
| 1.0 | 66.4 | 8.9 | 194 |

TABLE 3

| | Spring properties (JIS H3130 Repeated Deflection Test) | |
|---|---|---|
| Ag wt % | Young's modulus Kg/mm$^2$ | Spring limit value (Kb value) Kg/mm$^2$ |
| 0 | 7113 | 51.4 |
| 0.1 | 7218 | 57.8 |
| 0.3 | 7434 | 58.6 |

Value for reference: Kb value of phosphor bronze (8.0% Sn) plate = 47.9 Kb/mm$^2$ As seen from Tables 2 and 3, the addition of Ag not only contributes to the increase in strength and hardness but also is so effective for the improvement of spring properties as to give spring limit values (Kb value) as high as close to 60 Kg/mm$^2$.

In view of the fact that even phosphor bronze (Sn 8.0% PB), representative of the nonferrous spring alloys has a Kb value less than 50 Kg/mm$^2$, it may be concluded that the Al alloys of the present invention are sufficiently qualified as spring materials. Therefore, the alloys of the present invention may arrange suitable materials for precision springs for electronic devices, parts for terminal instruments, and so on.

While the embodiment of the present invention, as herein disclosed, constitute a preferred form, it is to be understood that other forms might be adopted.

What is claimed is:

1. A process for manufacturing high-strength high-elasticity Al alloys by subjecting melted Al alloys, which comprises 3.2–8.0 wt. % Zn, 1.2–4.5 wt. % Mg, 0.2–1.5 wt. % Cu, 0.1–1.2 wt. % Mn, 0.1–0.5 wt. % Cr, 0.005–0.2 wt. % B, 0.02–1.0 wt. % Be, 0.1–1.2 wt. % Ni or Co or mixtures thereof, 0.05–1.2 wt. % of Zr or Hf or mixtures thereof, 0.05–3.0 wt. % of Ag, a balance being Al and unavoidable impurities, to a nitriding treatment by blowing nitrogen gas into said melted alloys to increase the strength and elasticity of said Al alloys.

2. A process of manufacturing high-strength high-elasticity Al alloys according to claim 1, wherein after said nitriding treatment, said alloys are cast into an ingot, subjecting said ingot to a solution treatment and then an age-hardening treatment.

3. A process of manufacturing high-strength high-elasticity Al alloys according to claim 2, by subjecting said Al alloys to plastic working after being cast into ingots.

4. A process of manufacturing high-strength high-elasticity Al alloys according to claim 2, by performing said solution treatment at the temperature of 440°–520° C.

5. A high-strength high-elasticity Al alloy produced by the process of claim 1.

6. A high-strength high-elasticity Al alloy produced by the process of claim 2.

7. A high-strength high-elasticity Al alloy produced by the process of claim 3.

8. A high-strength high-elasticity Al alloy produced by the process of claim 4.

9. A process for manufacturing high-strength high-elasticity Al alloys by subjecting a melted Al alloy, said Al alloy comprising 0.2–1.5% wt. Cu, 0.1–1.2% wt. Mn, 0.1–0.5% wt. Cr., 0.005–0.2% wt. B, 0.02–1.0% wt. Be, 0.1–1.2% wt. of Ni or Co or mixtures thereof, 0.05–1.2% wt. of Zr or Hf or mixtures thereof, 0.05–3.0% wt. Ag, the remainder of said alloy being Al and unavoidable impurities, to a nitriding treatment, said treatment being conducted by blowing nitrogen gas into said melted Al alloy; and then adding 3.2–8.0% wt. Zn and 1.2–4.5% wt. Mg.

10. The product produced by the process of claim 9.

11. A high-strength high-elasticity al alloy produced by the process which comprises subjecting melted Al alloys, said alloys comprising 3.2–8.0 wt. % Zn, 1.2–4.5 wt. % Mg, 0.2–1.5 wt. % Cu, 0.1–1.2 wt. % Mn, 0.1–0.5 wt. % Cr, 0.005–0.2 wt. % B, 0.02–1.0 wt. % Be, 0.1–1.2 wt. % Ni or Co or mixtures thereof, 0.05–1.2 wt. % of Zr or Hf or mixtures thereof, 0.05–3.0 wt. % of Ag, a balance being al and unavoidable impurities, to a nitriding treatment by blowing nitrogen gas into said melted alloys to increase the strength and elasticity of said Al alloys.

* * * * *